US006605889B2

(12) United States Patent
Anami et al.

(10) Patent No.: US 6,605,889 B2
(45) Date of Patent: Aug. 12, 2003

(54) ELECTRODELESS LOW PRESSURE LAMP WITH MULTIPLE FERRITE CORES AND COILS

(75) Inventors: Shinichi Anami, Wellesley, MA (US); Robert Chandler, Lexington, MA (US); Oleg Popov, Needham, MA (US)

(73) Assignee: Matsushita Electric Works Ltd, Osaka (JP)

( * ) Notice: Subject to any disclaimer, the term of this patent is extended or adjusted under 35 U.S.C. 154(b) by 147 days.

(21) Appl. No.: 09/999,398

(22) Filed: Oct. 24, 2001

(65) Prior Publication Data

US 2003/0076020 A1 Apr. 24, 2003

(51) Int. Cl.[7] ..... H01J 1/50; H01J 11/00; H05B 41/10

(52) U.S. Cl. ..... 313/153; 313/490; 313/160; 313/161; 315/248; 315/344

(58) Field of Search ..... 313/153, 160, 313/161; 315/248, 344

(56) References Cited

U.S. PATENT DOCUMENTS 6,081,070 A * 6/2000 Popov et al. ..... 313/490

* cited by examiner

*Primary Examiner*—Nimeshkumar D. Patel
*Assistant Examiner*—Sharlene Leurig

(57) ABSTRACT

An electrodeless low pressure discharge lamp comprises an envelope made from a straight tube and a reentry cavity sealed to one of tube's ends. The cavity has several hollow ferrite cores separated from each other with a few mm distance. Each ferrite core has an induction coil of few turns wound around the core. Each cavity has a cooling copper tube or rod located inside the ferrite core that removes heat from the cores and dumps the heat into a heat sink welded to the cooling tube/rod thereby keep the temperature of the ferrite cores below their Curie point. Each induction coil is electrically connected to the matching network while all matching networks are connected in parallel to the high frequency power source (driver). Inductively coupled plasmas generated in the envelope by several core/coil assemblies produce axially uniform UV and visible radiation.

24 Claims, 4 Drawing Sheets

ELECTRODELESS LOW PRESSURE LAMP WITH MULTIPLE FERRITE CORES AND COILS

FIELD OF THE INVENTION

This invention relates to electric lamps and, more specifically, to low pressure (e.g. fluorescent lamps) operated at low and intermediate pressures at frequencies from 50 kHz to 3 MHz.

BACKGROUND OF THE INVENTION

Electrodeless fluorescent lamps utilizing an inductively coupled plasma have been widely used for indoor and outdoor applications. These lamps have longer life than conventional fluorescent lamps employing heating filaments. Presently, however, only a few electrodeless lamps have been brought to market. Most of them have a bulbous envelope: "Genura" (GEC), QL (Phillips), "Everlight" (MEW). Few are used for general lighting. They are not suitable for applications where long lamps with axially uniform light output are required (e.g. tunnel lighting).

A closed-loop electrodeless fluorescent lamp operated at a frequency of 250 kHz was recently introduced on the market by Osram/Sylvania and described in U.S. Pat. No. 5,834,905 by Godyak et al. This lamp has uniform light output along the envelope of 400 mm length and can be used in tunnel lighting. However, the width of that lamp is a rather large (140 mm) to fit in many reflectors used in tunnel lighting fixtures.

U.S. Pat. No. 5,382,879 to Council et al. described a long tubular fluorescent lamp operated at RF frequency from 30 MHz and higher. UV and visible radiations are produced by capacitive discharge plasmas generated inside the tube with the help of inner or outer RF electrodes positioned on the tube walls. However, the plasma power efficiency of a capacitive discharge operated without magnetic field at RF frequencies of f<400 MHz is relatively low since most of the RF power goes for the ion acceleration at the sheath. Also, the cost of the lamp driver at such high frequencies is high.

U.S. Pat. No. 5,760,547 to Borowiec described the electrodeless lamp with a bulbous envelope and a reentry cavity that employs two independently powered induction coils. Such an arrangement causes spreading of the plasma along the axis and results in a more axially uniform light output. However, this lamp is best used for operation at a high frequency (MHz range) where the induction coil of few turns can be used. For efficient operation at lower frequency, f<400 kHz, an electrodeless lamp requires low loss ferrite cores. Again, a lamp with a bulbous envelope does not have an axially uniform plasma and, hence, axially uniform radiation as required by the tunnel lighting.

SUMMARY OF THE INVENTION

According to the present invention, we have found an efficient electrodeless fluorescent lamp that is suitable for tunnel lighting and is operated at frequencies from 20 kHz to 3 MHz. The lamp comprises a glass, tubular, evacuated envelope having a length between about 50 and 2000 mm and a diameter between about 10 and 500 mm. The lamp further comprises one or more reentry cavities with a ferrite cores disposed in the cavities and a coil wound on each core. The axis of each core is coaxial with the cavity or coplanar with the axis. The cavities have lengths between about 10 and 1950 mm. A thermally conductive cooling rod or tube is disposed in each core and is attached to an external heat sink to draw heat from the cores. When using a tube, the outer diameter is between about 4 and 50 mm and the inner diameter is between about 2 and 50 mm. With a rod, the outer diameter is between about 4 and 50 mm.

A filling of an inert gas and a vaporous metal such as mercury, cadmium, sodium or the like is placed in the envelope. A protective coating is deposited on the vacuum side of the envelope and cavity walls. A conventional phosphor coating is deposited on the protective coating. A reflective coating (alumina or the like) is deposited on the vacuum side of the cavity walls, between the protective and phosphor coatings, to reflect the UV and visible light back to the envelope walls.

Cylindrical cores made from low loss ferrite material (such as ferrous-based MnZn or the like) are positioned inside each reentry cavity. Each core is wrapped with a primary coil which is electrically connected to a conventional matching network. All matching networks are connected in parallel and are powered by a high frequency power source, a driver. The driver generates a voltage at a high frequency, f=20–3,000 kHz, and is connected electrically to a power supply.

An object of the present invention is to design an efficient electrodeless fluorescent lamp suitable for tunnel lighting and operated at a frequency from 20 kHz to 3 MHz and power from 5 W to 1,000 W.

Another object of the present invention is to design an envelope with cavities having the proper position, shape, and size so to provide the sufficient volume inside the envelope for several plasmas needed for the efficient production of the axially uniform visible and UV radiations.

Yet another object of the present invention is to design an assembly that comprises the ferrite core and the induction coil that have very low power losses.

A further object of the present invention is to locate coil/core assemblies in an envelope to avoid the mutual interference of magnetic fields generated by each assembly.

The many other objects, features, and advantages of the present invention will become apparent to those skilled in the art upon reading the following specifications when taken in conjunction with the drawing and claims.

DESCRIPTION OF THE PREFERRED EMBODIMENTS

Figure 1:
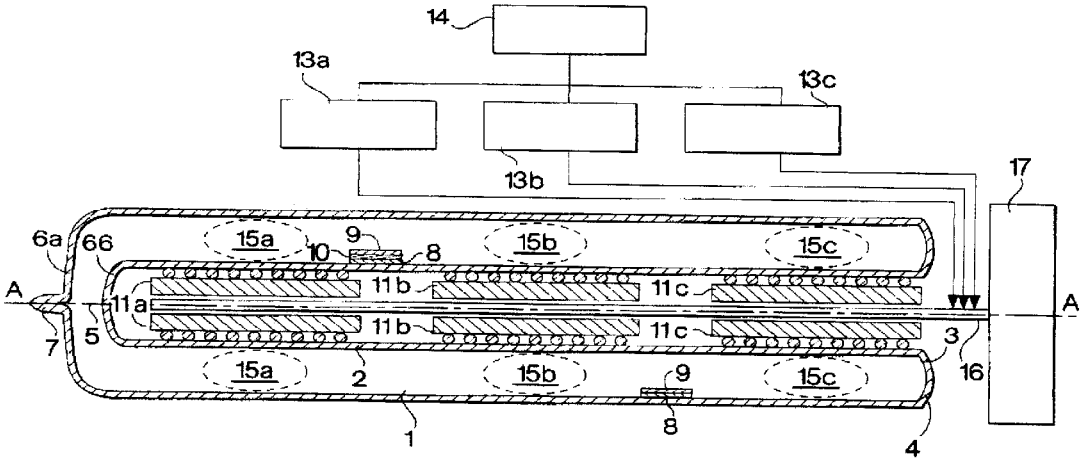
FIG. 1 is a cross sectional view with a schematic diagram of a first embodiment of the present invention.

Referring to FIG. 1, a lamp envelope 1 is a straight glass tube. The length of the envelope $H_{env}$ is substantially larger than the tube diameter, $D_{env}$. In the preferred embodiment, the length of the envelope 1, $H_{env}$=300 mm, and the diameter of the envelop, $D_{env}$=70 mm. A reentry cavity 2 is made from a straight tube and positioned on the axis A—A of the envelope 1. Cavity diameter, $D_{cav}$, and length, $H_{cav}$, are smaller than those of the envelope. The diameter of the cavity can be between about 5 and 100 mm. In the preferred embodiment, the cavity diameter, $D_{cav}$=25 mm, and the length, $H_{cav}$=290 mm. The bottom 3 of the envelope 1 is sealed to the open end 4 of the cavity 2. A small space 5 separates the top 6*a* of the envelope and the top 6*b* of the cavity. In this embodiment, the length of the space 5, $H_{e\text{-}c}$=10 mm.

The mercury vapor pressure in the envelope 1 is maintained by the temperature of a mercury drop (or an amalgam) disposed in the exhaust tubulation 7. The pressure of the inert gas (argon, krypton or the like) is between 0.01 torr and 10 torr. A protective coating 8 is deposited on the vacuum side of the envelope and cavity walls. A phosphor coating 9 is deposited on the protective coating 8. A reflective coating 10 (alumina and the like) is deposited on the vacuum side of the cavity 2 walls between the protective coating 8 and phosphor coating 9.

A plasma production means comprising several induction assemblies which include several hollow ferrite cores each having an induction coil. In the preferred embodiment, there are three assemblies with ferrite cores, 11*a*, 11*b* and 11*c*, and three coils 12*a*, 12*b* and 12*c*. All assemblies are positioned on the axis of the envelope 1 inside the cavity 2. In the preferred embodiment, all three ferrite cores have the same diameter and the same length. In other modifications, the ferrite cores may have different lengths.

The induction coil can have from 2 to 200 turns and the pitch between the turns is from 0.2 to 50 mm. The cores are cylindrical and can have a length between about 4 and 200 mm, an outer diameter between about 4 and 98 mm and an inner diameter between about 2 and 50 mm. In the preferred embodiment, all three coils have the same number of turns, N=40, and the same pitch of 6.0 mm. The coil can be made from copper wire of gauge from #10 to #52, each coated with a thin silver layer. In preferred embodiment, the coil wire is made from multi-stranded Litz wire having from 250 copper-made strands each of gauge #40. In other modifications, the number of strands can be from 20 to 600 and the gauge from #30 to #44.

Each coil is connected to a matching network. All matching networks 13*a*, 13*b*, 13*c* are connected in parallel to the power source (driver) 14 and individually tuned so to minimize the reflected power from each induction assembly. The ferrite cores 11*a*, 11*b* and 11*c* are separated a few millimeters from each other to minimize mutual interference of alternating magnetic fields generated by high frequency voltages applied from matching networks 12*a*, 13*b*, 13*c* on the coils 12*a*, 12*b*, 12*c*, respectively.

Alternating magnetic fields induce azimuthal alternating voltages in the envelope that ignite and maintain in the envelope the inductively coupled plasmas 15*a*, 15*b* and 15*c*. Each plasma has a toroidal shape and has the maximum plasma density, $N(z)=N_{max}$, approximately in the midplane of the correspondent ferrite core. Three toroidal plasmas 15*a*, 15*b* and 15*c*, excited and maintained in the envelope 1, occupy the volume that is substantially larger than that occupied by a single plasma generated by the single core and cell assembly. This results in the higher UV and visible radiations generated by the three plasmas, 15*a*, 15*b*, 15*c*, than that generated by a single plasma. Also, the axial distribution of visible radiation is more uniform in the lamp with three core/coil assemblies than in the lamp employing a single induction assembly.

Each of the ferrite cores, 11*a*, 11*b* and 11*c* is heated mainly by the correspondent plasma by convection via the cavity walls. To remove the heat from the ferrite cores and keep their temperatures below the Curie point (<200° C.), a solid rod 16 made from copper or other material having high thermal conductivity, such as aluminum, is inserted in hollow ferrite cores, 11*a*, 11*b*, 11*c* and welded to a heat sink 17 located below the envelope bottom 3.

Figure 2:
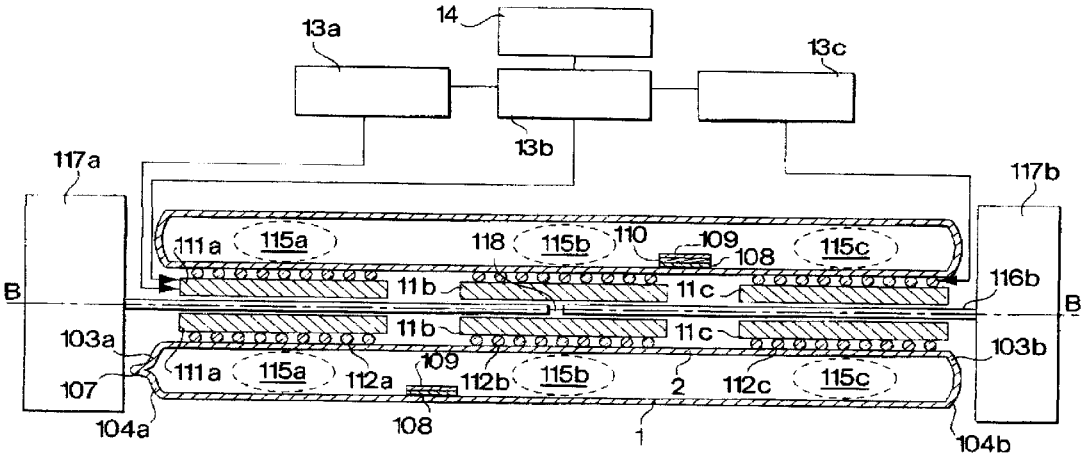
FIG. 2 is a cross sectional view with a schematic diagram of a second embodiment of the present invention.

The second embodiment of the present invention is shown schematically in FIG. 2. The envelope 101 is an open cylinder and is made from a straight glass tube having a diameter, $D_{env}$, substantially smaller than the envelope length, $H_{env}$. The envelope 101 incorporates on its axis B—B a cavity 102 that has a diameter, $D_{cav}$, smaller than that of the envelope 101. The length of the cavity 102, $H_{env}$ is essentially equal to the length of the envelope 102, that is $H_{cav}=M_{env}$. Two open ends, 103*a* and 103*b*, of the cavity 102 are sealed to two open ends, 104*a* and 104*b*, of the envelope 101 thereby making envelope 101 of a hollow shape.

The envelope is filled with an inert gas such as argon, krypton or the like at pressure between 0.01 torr and 10 torr. The vapor pressure of metal such as mercury, sodium or the like is controlled by the temperature of the mercury drop (or an amalgam) located in the exhaust tubulation 107. Protective coating 108 and phosphor coating 109 are deposited on the vacuum sides of the envelope and cavity walls. The reflective coating 110 is deposited on the vacuum side of the cavity walls between the protective and phosphor coatings 108 and 109, respectively.

Several induction assemblies, each comprising a ferrite core 111 and an induction coil 112 are inserted in the cavity 102 along the envelope axis. In the preferred embodiment, three assemblies with three cores 111*a*, 111*b* and 111*c* and three coils, 112*a*, 112*b*, 112*c* are employed.

Each induction coil is electrically connected to a matching network. Three matching networks 113*a*, 113*b*, 113*c* are connected in parallel to a power source (driver) 114. When the sufficiently high alternating voltage is applied to the induction coil, an inductively coupled toroidal plasma 115 is generated near the ferrite core. The maximum plasma density is located near the midplane of the ferrite core. The volume occupied by the three plasmas, 115*a*, 115*b*, 115*c* is substantially larger than the volume occupied by a single plasma generated by a single core/coil assembly. As the result, the UV and visible radiation produced by the three plasmas are higher than one produced by a single plasma. Also, the axial uniformity of the visible radiation is better in the case of three plasmas.

To keep the temperature of each ferrite core below the Curie point, two metal (copper, aluminum or the like) rods or tubes 116*a* and 116*b* are inserted in the cavity 102 along the envelope axis. Both rods (tubes) 116*a* and 116*b*, are thermally connected (welded or brazed) to two heat sinks 117*a* and 117*b*. A very tiny space 118 separates two rods in the center of the cavity. The length of the space 118 $H_{sp}$ is between 0.5 mm and 10 mm. In the preferred embodiment, $H_{sp}$=1 mm.

Figure 3:
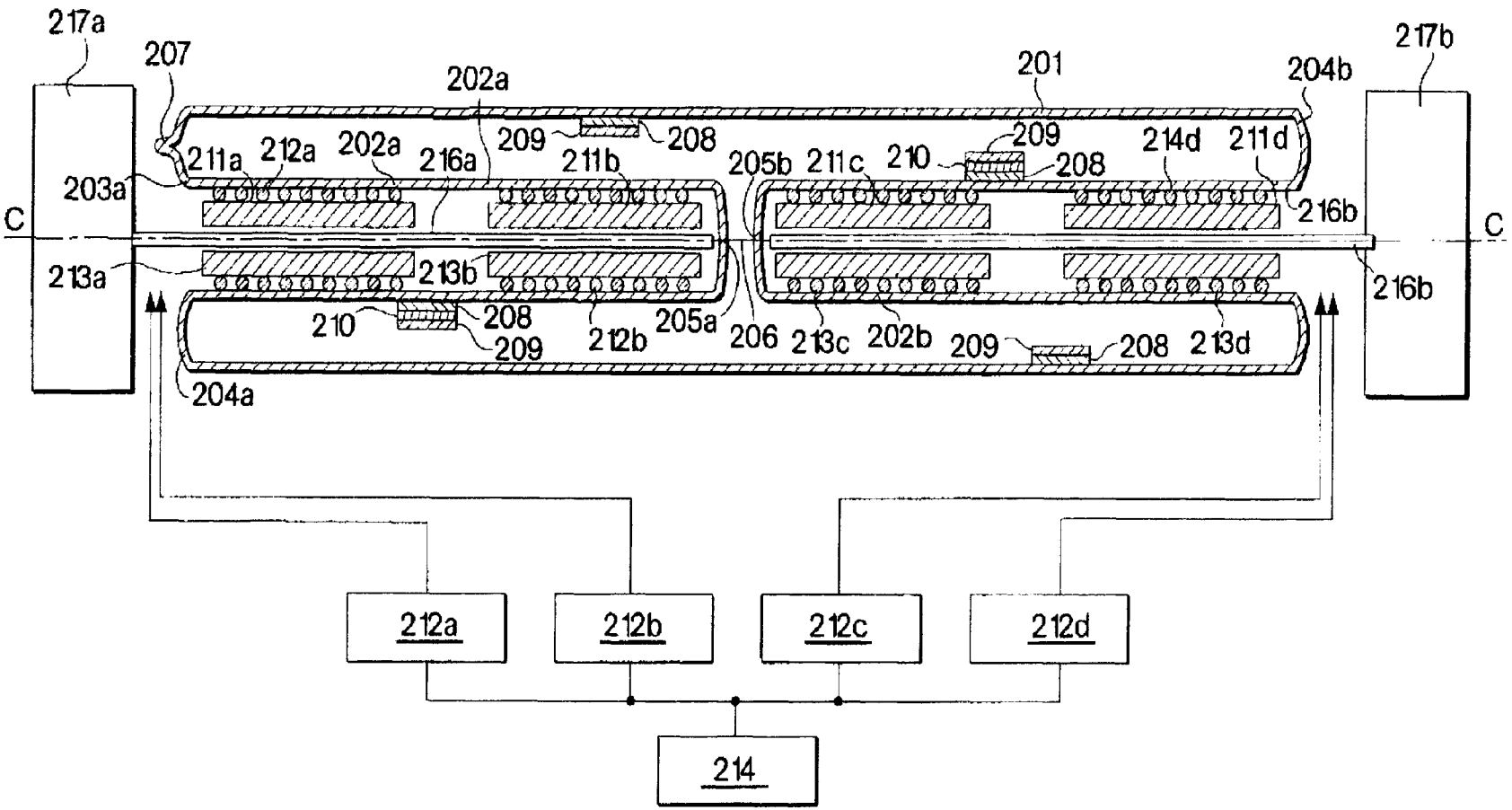
FIG. 3 is a cross sectional view with a schematic diagram of a third embodiment of the present invention.

The third embodiment of the present invention is shown in FIG. 3. The envelope 201 is made from a long straight glass tube. Two reentry cavities of the same diameter, 202*a* and 202*b*, are disposed on the axis C—C of the envelope 201. Each cavity has one open end 203*a* and 203*b* that are sealed to envelope's bottoms 204*a* and 204*b*. Two cavity tops 205*a* and 205*b* are separated from each other with a space 206. In the preferred embodiment, the length of the space 206, $H_{1\text{-}2}$, can be from 2 mm to 50 mm.

Protective and phosphor coatings 208 and 209 are deposited on the vacuum side of the wall of envelope 201 and cavities 202*a* and 202*b*. Reflective coating 210 is deposited on the vacuum side of cavity walls, between protective and phosphor coatings 208 and 209. Mercury vapor pressure is controlled by the temperature of the mercury drop (or an amalgam) positioned in the exhaust tubulation 207. The inert gas (argon, krypton, or the like) pressure is between 0.01 torr and 10 torr. In the preferred embodiment, argon pressure is about 0.120 torr.

The induction means comprises several induction assemblies positioned on the axis of both reentrant cavities. Each assembly comprises a ferrite core and an induction coil wound on the ferrite core. Each assembly is separated from two neighboring assemblies with space, $H_{f\text{-}f}$, that can vary from 2 to 200 mm. In the preferred embodiment, where four induction assemblies were employed with two assemblies in each cavity the space $H_{f\text{-}f}$ between each assembly was 10 mm. In other modifications, each cavity can have different number of induction assemblies.

Ferrite cores 211*a*, 211*b* and induction coils 212*a*, 212*b* are inserted in the cavity 202*a*. Ferrite cores 211*c*, 211*d*, and induction coils 212*c*, 212*d* are inserted in the cavity 202*b*. In the preferred embodiment, all coils have the same number of turns, 40, and the same pitch, 1 mm. In other modifications, coils can have different number of turns, from 2 to 200, and different height of the pitch, from 0.2 to 40 mm.

Two metal rods (tubes) 216*a* and 216*b* are used to keep temperatures of the ferrite cores below Curie point. Two ends of rods stick out from the cavities 202*a* and 202*b* and are thermally connected (welded or brazed) to the two heat sinks 217*a* and 217*b* respectively.

All four coils 203*a*, 203*b*, 203*c* and 203*d* are connected to four matching networks 212*a*, 212*b*, 212*c* and 212*d* respectively. Each matching network is tuned so to minimize the reflected power from the corresponding core/coil assembly. All matching networks are connected in parallel to the common power source (driver) 213.

An inductively coupled plasma generated by each core/coil has a toroidal shape with the maximum in plasma density near the core's midplane. A plasma resulting from the combination of four individual plasmas has much better axial uniformity than that of each individual plasma. Consequently, the UV and visible radiations produced by the four inductively coupled plasmas are also axially very uniform.

Figure 4:
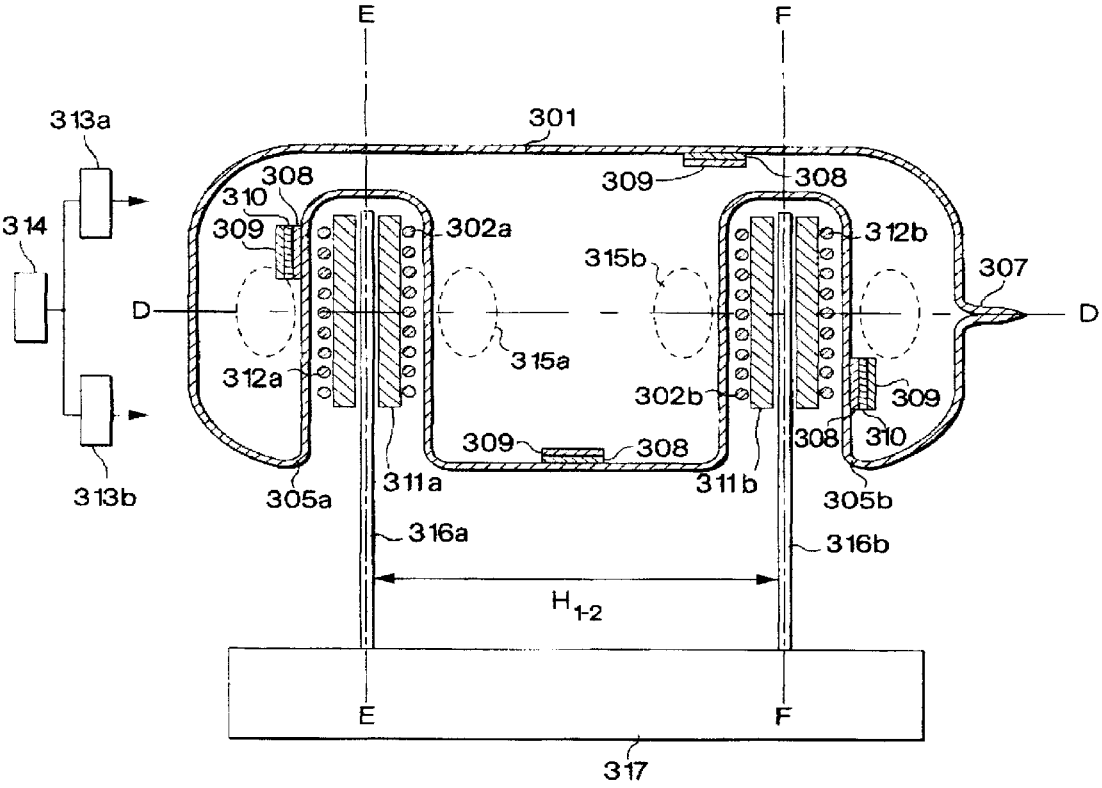
FIG. 4 is a cross sectional view with a schematic diagram of a fourth embodiment of the present invention.

The fourth embodiment of the present invention is shown in FIG. 4. The envelope 301 is made from the straight glass tube of 70 mm diameter and has a length of 440 mm. Several cavities are inserted in the envelope so their axes are perpendicular to axis D—D of the envelope. In the preferred embodiment presented in FIG. 4, two reentrant cavities 302*a* and 302*b* are sealed with their open ends to the envelope side walls. The axes E—E and F—F of cavities 302*a* and 302*b* are perpendicular to the axis D—D of the envelope 301 and are parallel to each other. In other modifications, axes of reentry cavities are not parallel to each other but lie in the parallel planes and are perpendicular to axis D—D.

Cavities 302*a* and 302*b* are sealed to envelope's walls with their open ends 305*a* and 305*b*. In the preferred embodiment, the distance, $H_{1\text{-}2}$, between axes E—E and F—F of cavities 302*a* and 302*b* is 220 mm. In other modifications, such as when a multiplicity of cavities, up to 50 for example, the distance between each neighboring cavities can vary from 5 to 500 mm. The height, $H_{cav}$, of cavities 302*a* and 302*b* is smaller than the diameter of the envelope 301, $D_{env}$=70 mm. In the preferred embodiment, $H_{cav}$,=60 mm, though in other modifications, the height of each cavity can be different and vary from 5 mm to 200 mm. The diameter of each cavity 302*a* and 302*b* is 25 mm, though in other modifications, the diameter of each cavity can be different and can vary from 5 mm to 100 mm.

The protective and phosphor coatings 308 and 309 are deposited on the vacuum side of walls of envelope 301 and cavity 302. The reflecting coating 310 is deposited on the vacuum side of the cavity 302 walls, between the protective and phosphor coatings, 308 and 309. The mercury pressure is maintained by the temperature of a mercury drop (or an amalgam) located in an exhaust tubulation 307.

Two ferrite cores, 311*a* and 311*b* are inserted in the cavities 302*a* and 302*b*, respectively. In the preferred embodiment, the height of both ferrite cores is the same, $H_f$=60 mm. In other modifications, the height of each ferrite core can vary from 5 to 100 mm. The diameter of each ferrite core is 20 mm. In other modifications, the diameter of each ferrite core can vary from 2 to 490 mm.

A coil 312*a* and 312*b* is wound on each of two ferrite cores 311*a* and 311*b*, respectively, and connected to one of two matching networks 313*a* and 313*b*, respectively. Each of two matching networks is tuned to minimize the reflected power from the correspondent induction assembly. Both matching networks 313*a* and 313*b* are connected in parallel to the power source (driver) 314.

Two cooling rods (tubes) 316*a* and 316*b* are used to keep the ferrite cores at temperatures below the Curie point. Each cooling rod is inserted into one of the correspondent ferrite cores 210*a* and 210*b* and welded (or brazed) to the heat sink 217.

Two toroidal plasmas 315*a* and 315*b* are ignited and maintained in the envelope 301 around two cavities 302*a* and 302*b*. The resulting UV and visible radiations produced by both plasmas are more axially uniform than that produced by a single plasma generated by the single induction assembly.

Figure 5:
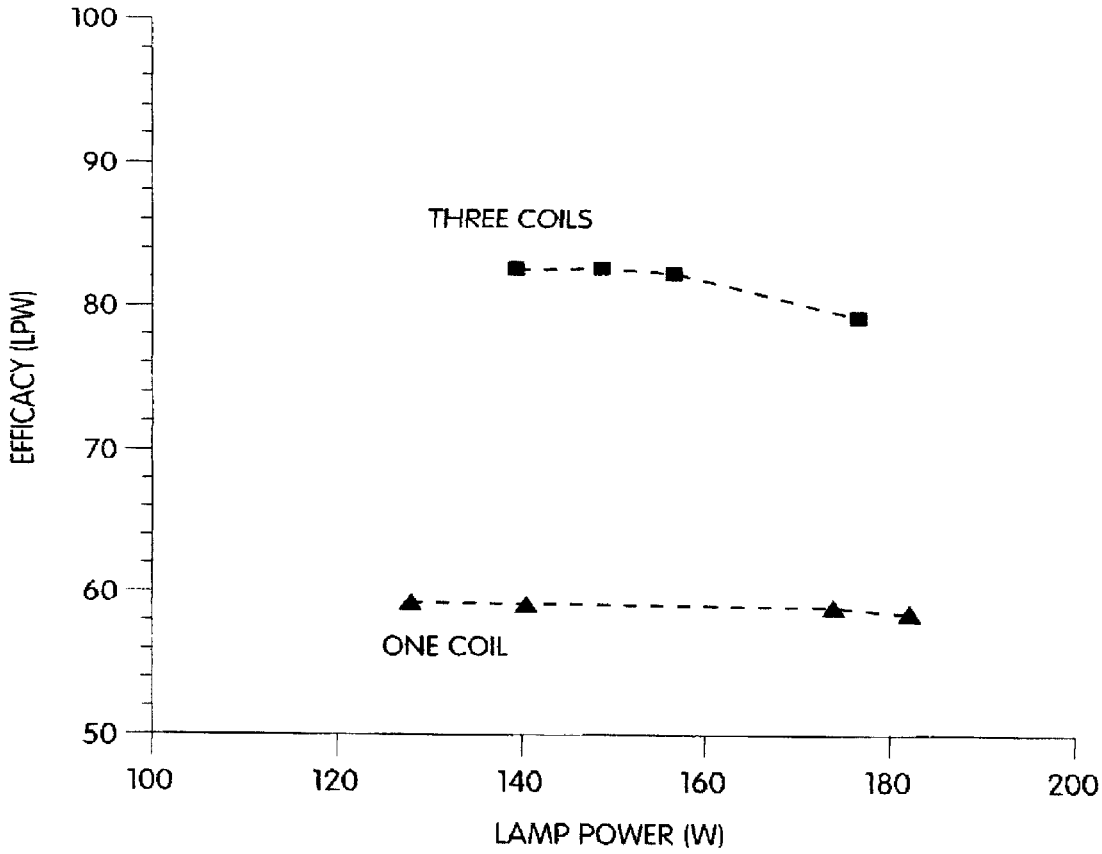
FIG. 5 is a graph showing lamp efficacy, $\epsilon$, as a function of lamp power, $P_{lamp}$, for the lamp built according to the first embodiment of the present invention and another according to the prior art. The driving frequency, f=320 kHz, and the argon pressure is 120 mtorr.

The graph in FIG. 5 shows the luminous efficacy, $\epsilon$, of the lamp built in accordance with the first embodiment of the present invention where three ferrite cores and three coils were employed. The data of the lamp efficacy, $\epsilon$, measured in the same lamp but with a single ferrite core/coil assembly (prior art) are also presented in FIG. 4. In the lamp, the envelope length, $H_{env}$=300 mm, the envelope diameter, $D_{env}$=70 mm, the cavity height, $H_{cav}$=290 mm, the cavity diameter, $D_{cav}$=25 mm. The driving frequency, f=320 kHz, argon pressure, p=120 mtorr.

It is seen that in case of three core/coil assembly, the lamp efficacy is much higher than that in case of the single core/coil assembly. Note that the power losses in ferrite cores and coils were essentially the same in both cases (6.5 W). The difference in efficacy is due to the larger envelope volume occupied by the three plasmas generated by the three induction assemblies compared with the volume occupied by the single core/coil plasma.

It is apparent that modifications and changes can be made within the spirit and scope of the present invention, but it is our intention, however, to be limited only by the scope of the appended claims.

As our invention, we claim:

1. An electrodeless low pressure lamp comprising:

an evacuated tubular glass envelope, said envelope having an outer wall and at least one reentry cavity disposed on said wall;

at least one conventional vaporous metal disposed in said envelope, the vapor pressure of said metal being controllable by the temperature of a cold spot or an amalgam disposed therein;

a filling of an inert gas at a pressure higher than about 10 mtorr;

a plurality of induction assemblies comprising ferrite cores disposed in said cavity and an induction coil associated with each of said cores, said coils being wound on each of said cores;

a cooling means, said cooling means being disposed in said cavity; and a matching network connected to each coil, each of said matching networks being connected in parallel to a high frequency power source.

2. The electrodeless low pressure lamp as defined in claim 1 wherein a conventional protective coating is deposited on the vacuum side of said envelope and cavity walls.

3. The electrodeless low pressure lamp as defined in claim 1 wherein a phosphor coating is deposited on said protective coating.

4. The electrodeless low pressure lamp as defined in claim 1 wherein a conventional reflective coating is deposited on the vacuum side of said cavity walls between said protective coating and said phosphor coating.

5. The electrodeless low pressure lamp as defined in claim 1 wherein said cooling means are disposed in said ferrite cores.

6. The electrodeless low pressure lamp as defined in claim 1 wherein a heat sink is thermally connected to said cooling means.

7. The electrodeless low pressure lamp as defined in claim 1 wherein said envelope is straight and has a length between about 50 and 2000 mm.

8. The electrodeless low pressure lamp as defined in claim 7 wherein the diameter of said envelope is between about 10 and 500 mm.

9. The electrodeless low pressure lamp as defined in claim 1 wherein there is a plurality of cavities in said envelope and wherein said cavities are disposed on the axis of said envelope or on a plane parallel to said axis.

10. The electrodeless low pressure lamp according to claim 9 wherein the diameter of the cavity is between 5 and 100 mm.

11. The electrodeless low pressure lamp as defined in claim 10 wherein said cavity has a multiplicity of said ferrite cores and axes of said cores coincide with the axes of said cavities.

12. The electrodeless low pressure lamp as defined in claim 11 wherein the distance between adjacent ferrite cores, along their axes is from 1 to 500 mm.

13. The electrodeless low pressure lamp as defined in claim 1 wherein the length of said ferrite core is between 4 and 200 mm.

14. The electrodeless low pressure lamp as defined in claim 1 wherein said ferrite core is cylindrical with an outer diameter from 4 to 98 mm and an inner diameter from 2 to 50 mm.

15. The electrodeless low pressure lamp as defined in claim 1 wherein said coil has from 2 to 200 turns and a pitch from 0.2 mm to 50 mm.

16. The electrodeless low pressure lamp as defined in claim 15 wherein said coil is made from multiple strands of Litz Wire.

17. The electrodeless low pressure lamp as defined in claim 16 wherein the number of said strands in said Litz wire is between 20 and 600.

18. The electrodeless low pressure lamp as defined in claim 1 wherein said cooling means is a structure and is formed of a metal of high thermoconductivity and low power losses.

19. The electrodeless low pressure lamp as defined in claim 1 wherein axes of said cavities are perpendicular to the axis of said envelope.

20. The electrodeless low pressure lamp as defined in claim 1 wherein said high frequency power source (driver) delivers to said matching networks a high frequency power from 5 to 5000 W at a frequency from 50 kHz to 3 MHz.

21. The electrodeless low pressure lamp as defined in claim 1 wherein said coil is made from copper wire.

22. The electrodeless low pressure lamp as defined in claim 21 wherein said copper wire has a gauge from #10 to #28.

23. The electrodeless low pressure lamp as defined in claim 18 wherein said structure is a rod or tube having diameter from 1 mm to 50 mm.

24. The electrodeless low pressure lamp as defined in claim 1 wherein said ferrite core is of rectangular shape.

* * * * *